US005705225A

United States Patent [19]

Dornfest et al.

[11] Patent Number: 5,705,225

[45] Date of Patent: Jan. 6, 1998

[54] METHOD OF FILLING PORES IN ANODIZED ALUMINUM PARTS

[75] Inventors: Charles Dornfest; Fred C. Redeker, both of Fremont; Mark Anthony Fodor, Los Gatos; Craig Bercaw, Sunnyvale; H. Steven Tomozawa, San Jose, all of Calif.

[73] Assignee: Applied Materials, Inc., Santa Clara, Calif.

[21] Appl. No.: 619,263

[22] Filed: Mar. 18, 1996

Related U.S. Application Data

[63] Continuation of Ser. No. 138,519, Oct. 15, 1993, abandoned.

[51] Int. Cl.[6] ..... C23C 16/28

[52] U.S. Cl. ..... 427/248.1; 427/255.3; 427/419.2; 427/419.3; 427/535; 427/569; 205/201; 148/272

[58] Field of Search ..... 427/248.1, 255.3, 427/419.2, 419.3, 535, 569; 205/201, 202, 203, 204; 148/272

[56] References Cited

U.S. PATENT DOCUMENTS

| | | | |
|---|---|---|---|
| 2,008,733 | 7/1935 | Tosterud | 205/202 |
| 4,103,048 | 7/1978 | Alexander | 205/203 |
| 5,069,938 | 12/1991 | Lorimer et al. | 427/255.1 |
| 5,192,610 | 3/1993 | Lorimer et al. . | |

FOREIGN PATENT DOCUMENTS

| | | | |
|---|---|---|---|
| 0 410 003 | 1/1991 | European Pat. Off. | C23C 28/04 |
| 58-197293 | 11/1983 | Japan . | |
| 62-130295 | 6/1987 | Japan . | |
| 63-192895 | 8/1988 | Japan . | |
| A 63 192 895 | 8/1988 | Japan | C25D 11/18 |
| 3-277797 | 12/1991 | Japan . | |
| A 03 287 797 | 12/1991 | Japan | C25D 11/18 |

OTHER PUBLICATIONS

Yoshimura, C. et al., "Effect of metal fluorides on sealing of oxide coatings on aluminum", CA 87:75493 (1973). (month unknown).

Pierson, "Handbook of Chemical Vapor Deposition", Noyes Publications, New Jersey (1992), pp. 227–228. (month not available).

EP Search Report for EP 94 11 6240, Feb. 1995.

*Primary Examiner*—Shrive Beck
*Assistant Examiner*—Timothy Meeks
*Attorney, Agent, or Firm*—Birgit E. Morris; Michael B. Einschlag

[57] ABSTRACT

Anodized aluminum coatings employed in semiconductor processing equipment are treated to reduce their sensitivity to halogenated species. The pores of the aluminum oxide surface can be filled either by a metal, such as magnesium or aluminum, forming the corresponding metal oxide that is resistant to reaction with halogens, or by filling the pores with a getter for halogens, such as hydrogen ions. The hydrogen ions adsorbed on the surface of the aluminum oxide react with halogens to form volatile hydrogen halides that can be pumped away in the exhaust system of the semiconductor processing chambers, thereby preventing or reducing reaction of the underlying aluminum oxide with the halogens.

2 Claims, 4 Drawing Sheets

METHOD OF FILLING PORES IN ANODIZED ALUMINUM PARTS

This is a continuation of U.S. application Ser. No. 08/138,519 filed Oct. 15, 1993 now abandoned.

This invention relates to improved anodization processes and anodized aluminum coatings. More particularly, this invention relates to treated anodized aluminum coatings useful in harsh environments and processes for making the same.

BACKGROUND OF THE INVENTION

Aluminum metal is used in the semiconductor industry for parts and liners for various processing chambers including chemical vapor deposition and etch chambers. For example, substrate supports, susceptors, chamber walls and the like are made of aluminum metal. The aluminum becomes oxidized in air to form a thin native aluminum oxide coating thereon which is impervious to some of the chemical species generated in such chambers during standard processing. However, chemicals such as halides, e.g., bromides, chlorides and fluorides, are employed as etch and deposition gases, for example, and some of these processes are carried out in plasmas and/or at elevated temperatures. These chemicals will also etch or otherwise degrade aluminum and eventually the relatively thin native oxide coatings. Thus a thicker protective coating of aluminum oxide is desired.

Aluminum oxide coatings thicker than native oxide coatings can be made by anodizing the aluminum. Anodization can be carried out by making aluminum the anode and forming a suitable electrolyte in an electrolytic cell. Suitable electrolytes include inorganic acids such as nitric acid and sulfuric acid; or organic acids such as acetic acid or oxalic acid, for example. A DC voltage of 15–45 volts is applied until an aluminum oxide coating layer of the desired thickness over the aluminum metal is obtained, suitably about 0.5–2 mils thick.

FIG. 1A is a photomicrograph (110×) of the top surface of a grit blasted anodized aluminum surface that was anodized using oxalic acid. The aluminum oxide surface is quite uniform.

FIG. 1B is a photomicrograph (30,000×) of a cross section of an oxalic acid treated aluminum surface illustrating the somewhat porous, columnar structure of the aluminum oxide surface. Anodized aluminum is employed to protect aluminum parts from harsh etch environments. However, as shown in FIG. 1B, anodized aluminum is somewhat porous, and eventually the anodized coating is also attacked by harsh chemical species, particularly halogens, thereby exposing and etching away the underlying aluminum metal.

FIG. 2A is a photomicrograph (110×) of an oxalic acid anodized aluminum surface that has been exposed to a $CF_4/N_2O$ plasma at about 420° C. for about 150 hours. It is apparent that the aluminum oxide has flaked away in many areas, exposing the underlying aluminum metal surface.

FIG. 2B is a photomicrograph (110×) of an anodized aluminum part as in FIG. 1A which was scribed with a diamond scribe to damage the surface and thereby accelerate exposure of the surface to a halogen-containing plasma. After about 150 hours of exposure to $CF_4/N_2O$ plasma at 420° C., most of the aluminum oxide surface has deteriorated, and nodules evidencing halogen attack are present on the underlying aluminum surface. Thus these parts now must be replaced.

Various attempts have been made to treat anodized aluminum surfaces to prevent attack by halogen-containing species, but they are not suitable for use in semiconductor equipment used to process silicon wafers. For example, anodized aluminum has been "sealed" in boiling water, which probably adds oxygen in the form of $OH^-$ groups to fill in the porous surface. However, moisture or residual $OH^-$ groups tend to be released at high temperature and vacuum environments, which lead to undesirable reactions with halogens which can attack aluminum and silicon substrates, as well as other layers on the substrates.

Nickel has also been used to seal anodized aluminum pores, as by treating anodized aluminum surfaces with nickel fluoride or nickel acetate. However, nickel treatment is not suitable for semiconductor processing either because nickel can contaminate semiconductor substrates. U.S. Pat. No. 5,192,610 to Lorimer et al, assigned to the same assignee as the present invention, discloses a process of forming a protective coating of an aluminum oxide treated with a fluorine-containing gas.

In addition, various protective polymers have been coated onto anodized aluminum surfaces, but polymers cannot withstand plasma processing and/or the high temperatures employed in certain semiconductor processes such as chemical vapor deposition. The result is that the polymers degenerate and can flake off, causing particulates to form in the reaction chamber that will contaminate substrate surfaces, and reduce the yield of devices from these substrates.

Thus it would be highly desirable to be able to provide anodized aluminum coatings that are impervious to excited halogen species for comparatively longer periods of time, without attack of the underlying aluminum.

SUMMARY OF THE INVENTION

We have found that anodized aluminum coatings can be treated to fill in the pores of the aluminum oxide, thereby making a less permeable surface that is more resistant to activated halogen and other active species generated in a processing chamber. Such treatment increases the length of time that the treated anodized aluminum parts can be kept in service without replacement or re-anodization.

In a first embodiment of the present invention, anodized aluminum pores are filled in with a metal oxide and/or metal fluoride to reduce attack by active halogen species.

In another embodiment of the present invention, the pores of aluminum oxide are treated with a reducing agent. The reducing agent produces $H^+$ ions which are adsorbed on the surface of the aluminum oxide coating layer. These adsorbed $H^+$ ions getter materials such as halogen ions, forming gaseous or volatile HX products which can be readily removed from the processing chamber, thus eliminating or reducing attack of the anodized aluminum by active species.

DETAILED DESCRIPTION OF THE INVENTION

We have found that anodized aluminum surfaces can be treated to reduce their sensitivity to halogen species. The anodized aluminum surfaces can be treated either to reduce their porosity, e.g., to fill in the pores with another material that is relatively inactive to harsh semiconductor processing environments; or to provide an adsorbed getter on the surface of the pores to prevent harsh chemical attack of the anodized surface.

To further describe the first embodiment, anodized aluminum is treated to deposit a metal salt in the pores of the anodized aluminum. For example, the anodized aluminum part can be immersed in a soluble metal oxide salt solution such as magnesium acetate solution. The anodized aluminum part can be treated by immersing the part in a soluble magnesium salt solution, such as magnesium acetate, which wets the surface and fills in the pores of the aluminum oxide surface. When the magnesium acetate is heated, e.g., to about 550° C., the soluble magnesium salt decomposes to form an insoluble magnesium oxide, thereby filling the aluminum oxide pores with magnesium oxide. Magnesium oxide is not attacked by active halogenated species. For example, magnesium oxide can react with fluoride ions to form a nonvolatile magnesium fluoride ($MgF_2$).

The anodized aluminum part can also be treated to deposit aluminum oxide in the pores. For example, the anodized aluminum part can be treated with a colloidal suspension or an organoaluminum compound, such as aluminum secondary butoxide, in a solvent, e.g., butyl alcohol. After exposure of the treated part to elevated temperature, e.g., 200°–500° C., aluminum oxide is formed in the pores of the anodized part.

Alternatively, aluminum oxide can be deposited by chemical vapor deposition (CVD). The anodized aluminum part is loaded into a chemical vapor deposition chamber and a suitable organoaluminum precursor gas fed to the chamber while maintaining the temperature of the part over about 200° C., preferably at above 350° C. or higher. Aluminum oxide is deposited into the pores of the anodized aluminum part, effectively sealing heat generated defects in the anodized aluminum surface.

Figure 1A:
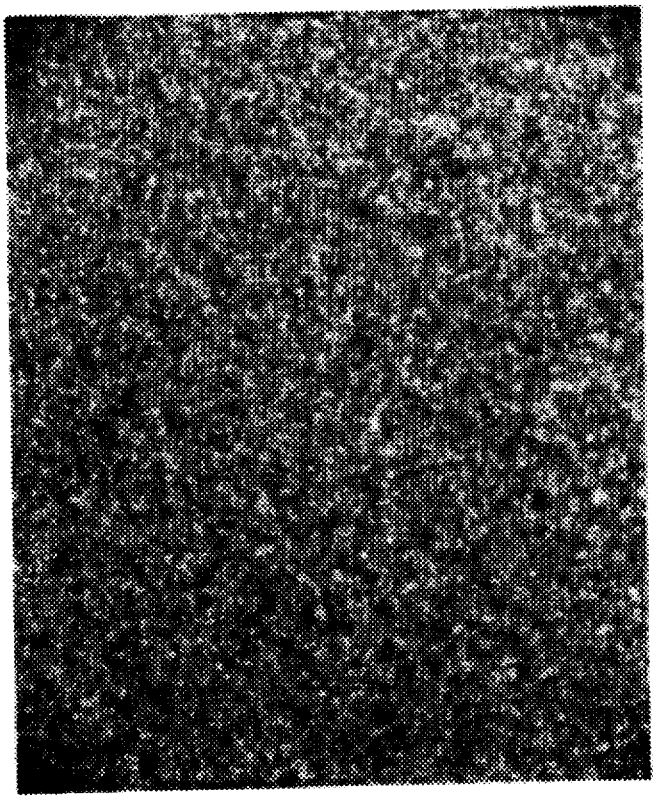
FIG. 1A is a photomicrograph of the top of an anodized aluminum surface.
Figure 1B:
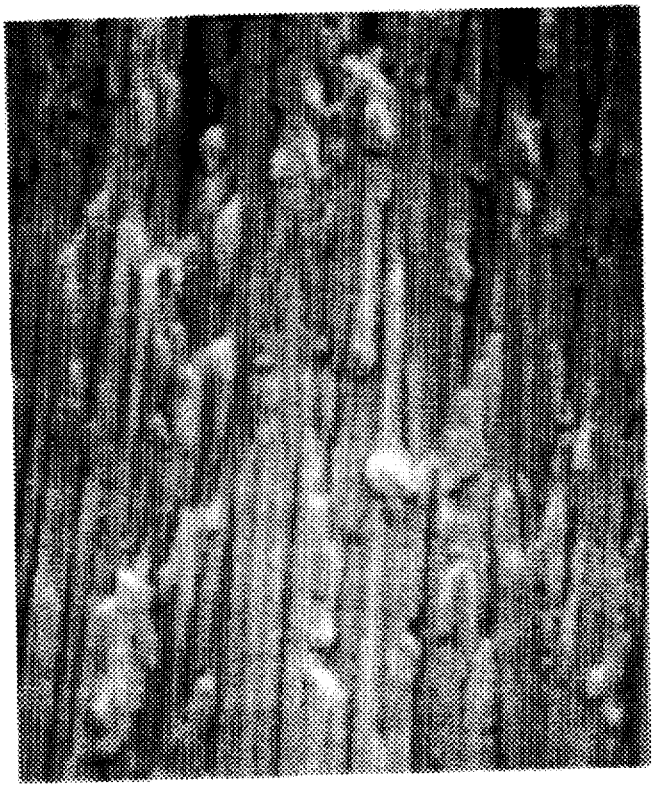
FIG. 1B is a photomicrograph of a cross sectional view of an anodized aluminum surface.
Figure 2A:
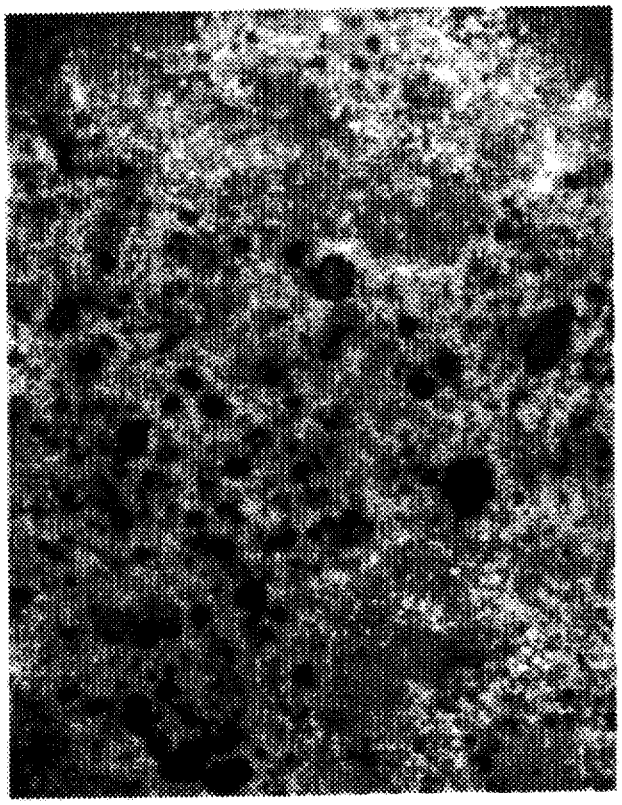
FIG. 2A is a photomicrograph of an anodized aluminum surface that has been exposed to a halogen-containing plasma.
Figure 2B:
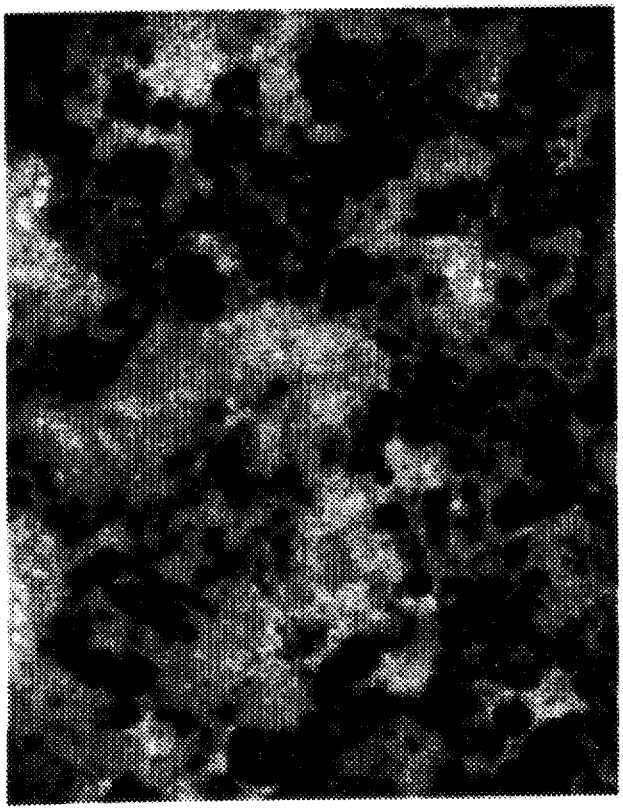
FIG. 2B is a photomicrograph of a damaged anodized aluminum surface that has been exposed to a halogen-containing plasma.
Figure 3A:
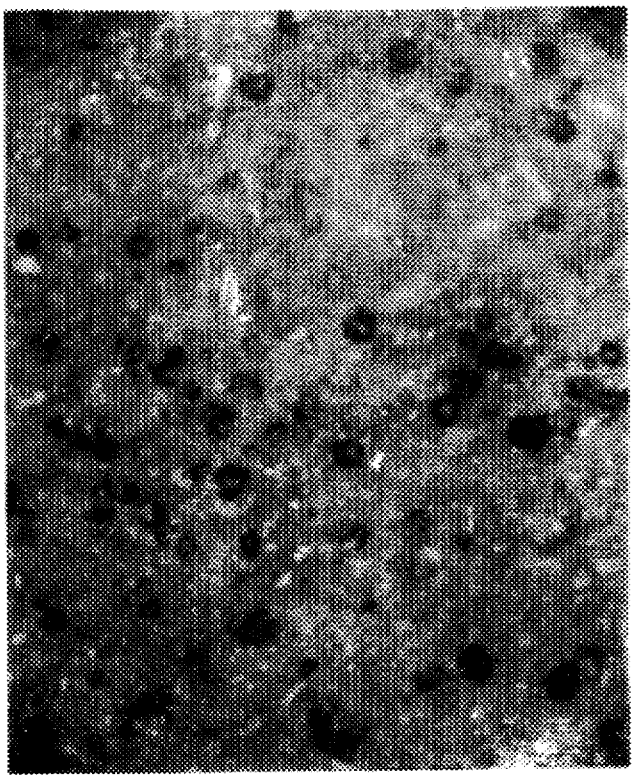
FIG. 3A is a photomicrograph of an anodized aluminum surface that has been exposed to a halogen-containing plasma.
Figure 3B:
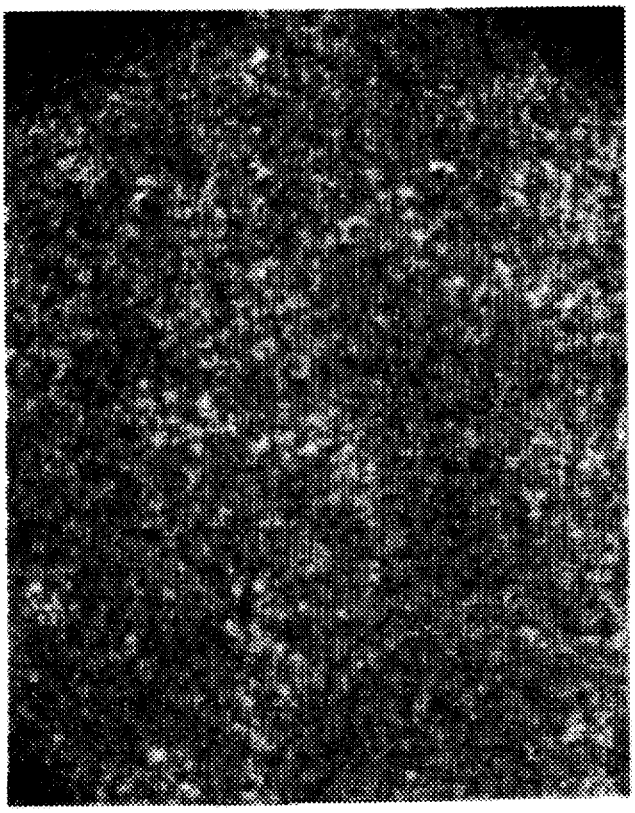
FIG. 3B is a photomicrograph of an anodized aluminum surface that has been treated with a magnesium salt solution that has been exposed to a halogen-containing plasma.

To illustrate the protective effects of this mode of treatment, reference is made to FIGS. 3A and 3B. FIG. 3A is a photomicrograph (110×) of a prior art oxalic acid anodized aluminum surface which was exposed to a $CF_4/N_2O$ plasma for about 100 hours at 420° C. The original aluminum oxide coating has been largely replaced with halogen reaction by-products (aluminum fluoride) on the surface of the aluminum.

In accordance with the invention however, after formation of an anodized aluminum oxide surface using oxalic acid, the anodized surface was then treated with a soluble magnesium salt solution and magnesium oxide formed in the pores of the alumina. The surface was then exposed to the same plasma as above. In contrast to the surface shown in FIG. 3A, the surface of the magnesium-treated aluminum oxide remained uniformly coated with a protective aluminum oxide coating.

Figure 3C:
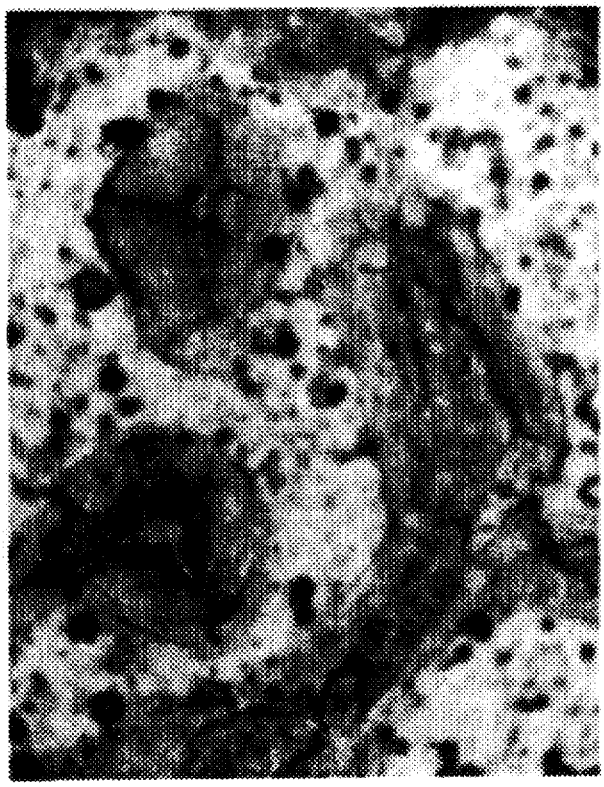
FIG. 3C is a photomicrograph of an anodized magnesium-containing aluminum surface that has been exposed to a halogen-containing plasma.

As a further comparison, FIG. 3C is a photomicrograph (110×) of a sulfuric acid anodized aluminum surface wherein the aluminum was 6061 aluminum which contained a minor amount, about 1.2% by weight, of magnesium. However, the presence of only small amounts of magnesium was not sufficient to protect the anodized surface. FIG. 3C shows that an anodized 6061 aluminum surface that was anodized with sulfuric acid and exposed to the same plasma conditions as given above as for FIG. 3A was insufficient to provide protection for the aluminum and that the surface had badly deteriorated.

As an example of obtaining the improved anodized coatings of the invention in accordance with the first embodiment, the anodized aluminum part was treated with a soluble magnesium salt, such as magnesium acetate. The part, e.g., a susceptor, was then heated to a temperature sufficient to form magnesium oxide, e.g., about 400°–550° C., and preferably heated to a temperature of over about 402° C. The resultant magnesium oxide bonded to the aluminum oxide under these conditions, which can form an excellent barrier layer for the underlying aluminum. Similar results are obtained by depositing aluminum oxide in the pores of the subject anodized coatings.

Magnesium oxide can optionally and preferably be treated with fluorine to form magnesium fluoride in the pores of the aluminum oxide. Magnesium fluoride expands during heating, thereby generating compressive stress. This compressive stress tends to mitigate the tensile stress which is inherent in aluminum oxide anodization because of the differences in the thermal coefficients of expansion and resulting mismatch between the magnesium oxide, the aluminum oxide and aluminum metal upon heating. These tensile stresses and thermal mismatch will cause cracks and other defects in anodized coatings, which also expose the underlying aluminum to attack by harsh processing chemicals.

Figure 4:
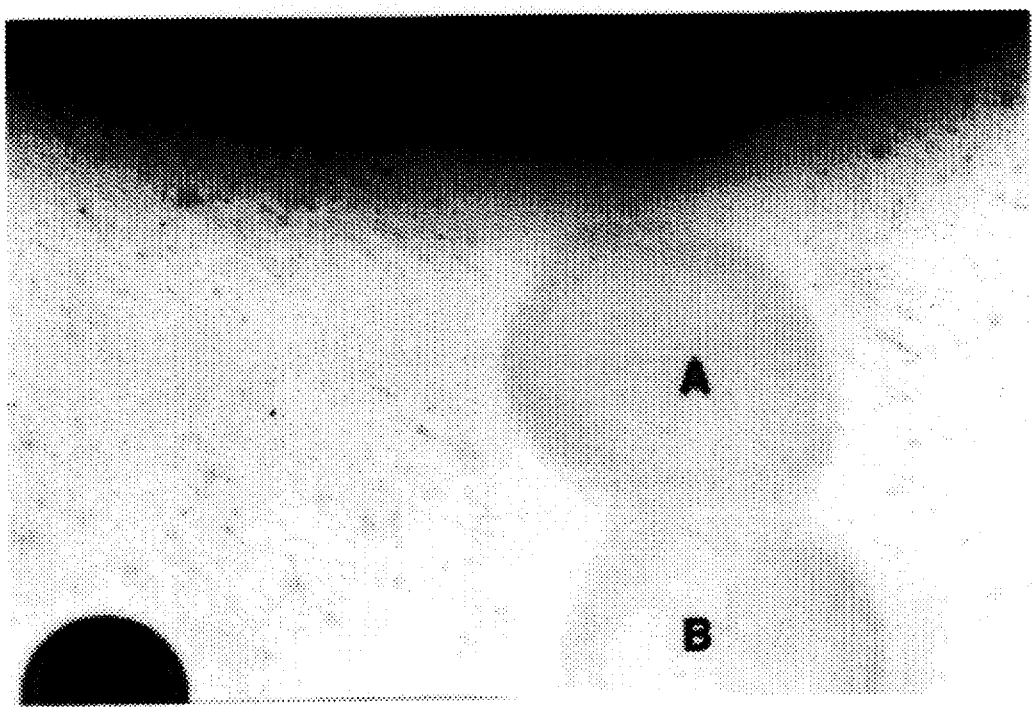
FIG. 4 is a photomicrograph comparing a magnesium-treated and untreated areas of an anodized aluminum surface that has been exposed to a halogen-containing plasma.

FIG. 4 is a photomicrograph of an aluminum surface that was anodized in a first circular area, indicated as A, using oxalic acid to form an anodized aluminum surface. A second circular area, indicated as B, was first anodized using oxalic acid and then treated with magnesium acetate, heated to form magnesium oxide, which was then treated with fluorine. As shown in FIG. 4, the untreated region A is smoother and has less surface roughening. The anodized and magnesium treated aluminum surface was then exposed to a $CF_4/N_2O$ plasma for about 100 hours. It is also apparent that the untreated area has been attacked by the plasma more than the magnesium-treated area.

Preferably, the formation of magnesium fluoride from magnesium oxide is performed during normal chamber operations, as by treating the anodized aluminum having magnesium oxide-filled pores with fluorine at elevated temperatures between the processing of substrates. The magnesium fluoride film is advantageous because it is a thermodynamically stable compound with a low vapor pressure, which does not adversely affect the character of standard processing of semiconductor substrates such as silicon wafers.

Another advantage of the present method is that the magnesium oxide pore filler has a gettering effect on fluoride. The above processing with fluorine forms magnesium fluoride by reaction with the surface magnesium oxide molecules, leaving unreacted magnesium oxide below the magnesium fluoride surface. This unreacted magnesium oxide acts as a reservoir of getter material that will react with any fluoride ($F^-$) species that penetrate the surface magnesium fluoride, thereby further protecting the aluminum substrate from attack by halogens such as fluoride ions.

In order to carry out the second embodiment of the present invention, anodized aluminum surfaces are treated with a reducing gas, such as $NH_3$. The reducing gas is a source of $H^+$ ions, which are adsorbed into the pores of the anodized aluminum. During semiconductor processing, the adsorbed $H^+$ ions act as getters for active halogens, forming HX for example. HX compounds are generally gaseous or at least volatile materials that can readily be removed from the processing chamber, as through the chamber exhaust system, before the halogen can attack the underlying aluminum.

To illustrate this process, after a standard plasma clean of an etch chamber, a plasma from $NH_3$ was formed in the chamber by passing ammonia into the chamber between processing cycles. Hydrogen ions formed in the plasma will adsorb onto the aluminum oxide surfaces. As another illustration, aluminum oxide parts in a chemical vapor deposition chamber can also be treated. In the case of silicon nitride for example, ammonia is already part of the reaction gases, which can continue to be passed into the chamber between deposition cycles.

The hydrogen ions can be supplied either separately from normal substrate processing, or, preferably, as part of a standard process. As one example, hydrogen was supplied from an ammonia plasma following a standard plasma clean step between substrate processing steps in a chemical vapor deposition chamber having an anodized aluminum susceptor. The $H^+$ ions were adsorbed into the cleaned pores, thus replacing or augmenting the prior art seasoning procedure used normally at this point. As another example, plasma enhanced chemical vapor deposition of silicon nitride coatings uses ammonia as one of the processing gases as a source of nitrogen. Thus by feeding in one of the processing gases, ammonia, prior to adding other deposition gases such as silane, the hydrogen ion adsorption is carried out and the objectives of the present invention are accomplished without interrupting normal processing sequences.

Although the present invention has been described in terms of specific embodiments, various changes of reagents and processing conditions can be made without departing from the spirit of the invention, as will be known to one skilled in the art. Such changes are meant to be included herein and the invention is not to be limited except by the scope of the appended claims.

We claim:

1. A method of filling in pores in an anodized aluminum part for a vacuum chamber, said part having magnesium oxide deposited on its surface, comprising a) loading the anodized aluminum part into a vacuum chamber;

b) passing a plasma precursor gas containing fluorine into the chamber while maintaining the chamber at a temperature over 200° C. wherein the pores of said anodized aluminum part are filled with magnesium fluoride.

2. A method according to claim 1 wherein the temperature of the chamber is maintained at a temperature of from 200° C.–500° C.

* * * * *